US007513705B1

(12) United States Patent
Arrington et al.

(10) Patent No.: US 7,513,705 B1
(45) Date of Patent: Apr. 7, 2009

(54) TOOLLESS THERMAL PRINT HEAD MOUNTING APPARATUS

(75) Inventors: Stacy L. Arrington, Raleigh, NC (US); Richard H. Harris, Raleigh, NC (US); Dean F. Herring, Youngsville, NC (US); Robert A. Myers, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/143,150

(22) Filed: Jun. 20, 2008

Related U.S. Application Data

(63) Continuation of application No. 11/945,625, filed on Nov. 27, 2007, now Pat. No. 7,410,312.

(51) Int. Cl.
*B41J 25/304* (2006.01)
*B41J 2/32* (2006.01)

(52) U.S. Cl. ..... 400/120.16; 347/197

(58) Field of Classification Search ..... None
See application file for complete search history.

(56) References Cited

U.S. PATENT DOCUMENTS 4,708,502 A 11/1987 Murakami
4,896,166 A * 1/1990 Barker et al. ..... 347/197
5,565,905 A 10/1996 Kajiya et al.
5,694,159 A * 12/1997 Kajiya et al. ..... 347/197
5,779,371 A * 7/1998 Aoyama et al. ..... 400/120.16
6,008,832 A 12/1999 Sato
7,245,312 B2 7/2007 Smolenski et al.
2005/0276645 A1 12/2005 Hirte et al.
2006/0103714 A1 * 5/2006 Nakata ..... 347/171

* cited by examiner

*Primary Examiner*—Daniel J Colilla
(74) *Attorney, Agent, or Firm*—Cantor Colburn LLP; Jason Piche

(57) ABSTRACT

A toolless thermal print head mounting apparatus including; a print head mounting bracket including a front face and a rear face, a plurality of print head mounting stud holes and a plurality of cable clamp mounting slots formed in the print head mounting bracket, each of the plurality of cable clamp mounting slots including a side slot and a vertical slot, a capture latch operatively connected to the print head mounting bracket, a plurality of key-slots formed in the capture latch and aligned with the plurality of mounting stud holes, and a floating cable clamp including a plurality of shoulder pins disposed on a rear face thereof, each of the plurality of shoulder pins including a neck configured to pass through the plurality of cable clamp mounting slots and a head configured to be larger than a width of the vertical slot of the cable clamp mounting slots.

1 Claim, 8 Drawing Sheets

TOOLLESS THERMAL PRINT HEAD MOUNTING APPARATUS

CROSS REFERENCE TO RELATED APPLICATIONS

This application is a continuation of U.S. patent application Ser. No. 11/945,625, filed Nov. 27, 2007, the disclosure of which is incorporated herein by reference in its entirety.

BACKGROUND OF THE INVENTION

1. Field of the Invention

This invention relates generally to a system for toolless thermal print head mounting/removal, and more particularly, to a toolless thermal print head mounting apparatus including a print head mounting bracket having side slots and print head mounting stud holes, a floating cable clamp with shoulder pins configured to fit within the side slots and a dual key-slot capture latch disposed on the rear of the print head mounting bracket to capture mounting studs disposed on a print head.

2. Description of the Background

Thermal printers are used in a wide variety of applications. A recent trend in the use of such printers is in point of sale ("POS") printing of sales receipts. Thermal printers provide for operation at a relatively fast printing speed without the need for ink. The thermal printers include a print head having a print face which typically consists of arrays of numerous heating elements. However, the heating elements may become worn after extended periods of use, making it necessary to periodically replace the print head. Traditionally, removal of a failed print head requires major disassembly of the printer. Therefore, quick and easy replacement of the thermal print head is desirable.

To address this issue, thermal printer manufacturers have attempted to differentiate themselves from their competitors by providing features that simplify a thermal print head replacement process. For example, manufacturers have introduced thermal printers with separate carriage assemblies including fastening structures wherein the carriages may be detached from the printer. However, although these carriage assemblies may simplify the thermal print head replacement process, these carriage assemblies considerably increase the size and cost of the print head component of their respective thermal printers.

In addition, tools are often required to remove the thermal print head from the thermal printer. The application of tools to the confined spaces of the thermal printer is a delicate task requiring precision from the user. This ultimately requires a large input of time and effort by the user to replace the thermal print head. Therefore, what is needed is a simpler and less expensive feature for a thermal printer which is used to replace the thermal print head quickly and easily without the use of tools.

In addition, it is highly desirable to have more than one component supplier for a component as critical as the thermal print head. The availability of a plurality of suppliers ensures that a continuous supply of print heads may be had and that competition among suppliers will ensure a low cost product. However, a problem arises in that the different suppliers may supply print heads having differing dimensions; this is especially true of intra-vendor variances in the vertical distance between a print line of the print head and the a cable connector of a print head. Therefore, what is needed is a print head mounting apparatus which can accommodate print heads having a wide range of dimensions.

SUMMARY OF THE INVENTION

An embodiment of the invention includes a toolless thermal print head mounting apparatus including; a print head mounting bracket including a front face and a rear face disposed substantially opposite the front face, a plurality of print head mounting stud holes formed in the print head mounting bracket, a plurality of cable clamp mounting slots formed in the print head mounting bracket, each of the plurality of cable clamp mounting slots including a side slot and a vertical slot, a capture latch operatively connected to the rear face of the print head mounting bracket, a plurality of key-slots formed in the capture latch and aligned with the plurality of mounting stud holes, and a floating cable clamp including a plurality of shoulder pins disposed on a rear face thereof, each of the plurality of shoulder pins including a neck configured to pass through the plurality of cable clamp mounting slots and a head configured to be larger than a width of the vertical slot of the cable clamp mounting slots, wherein the floating cable clamp is configured to be pivotally coupled to the print head mounting bracket by the shoulder pins and the cable clamp mounting slots.

In one embodiment, the toolless thermal print head mounting apparatus further includes a spring element disposed on the front face of the print head mounting bracket, the spring element configured to provide a pivoting force to the floating cable clamp.

In one embodiment, the capture latch is operatively connected to the rear face of the print head mounting bracket via a plurality of capture latch mounting studs disposed on the rear face of the print head mounting bracket and a plurality of capture latch mounting slots formed in the capture latch and aligned with the plurality of capture latch mounting studs.

In one embodiment, the toolless thermal print head mounting apparatus further includes a handle disposed on the capture latch, the handle configured to facilitate a horizontal movement of the capture latch.

In one embodiment, the floating cable clamp includes; a front clamp, and a rear clamp connected to the front clamp, wherein the front clamp and the rear clamp are configured to restrain a cable therebetween.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF SPECIFIC EMBODIMENTS

According to exemplary embodiments, a toolless thermal print head mounting apparatus allows for easy removal and installation of a thermal print head by including a print head mounting bracket which accepts a floating cable clamp configured to pivotally eject a thermal print head and which also accepts a capture latch to fix or release mounting studs on the thermal print head in order to fix the thermal print head to the print head mounting bracket.

Figure 1:
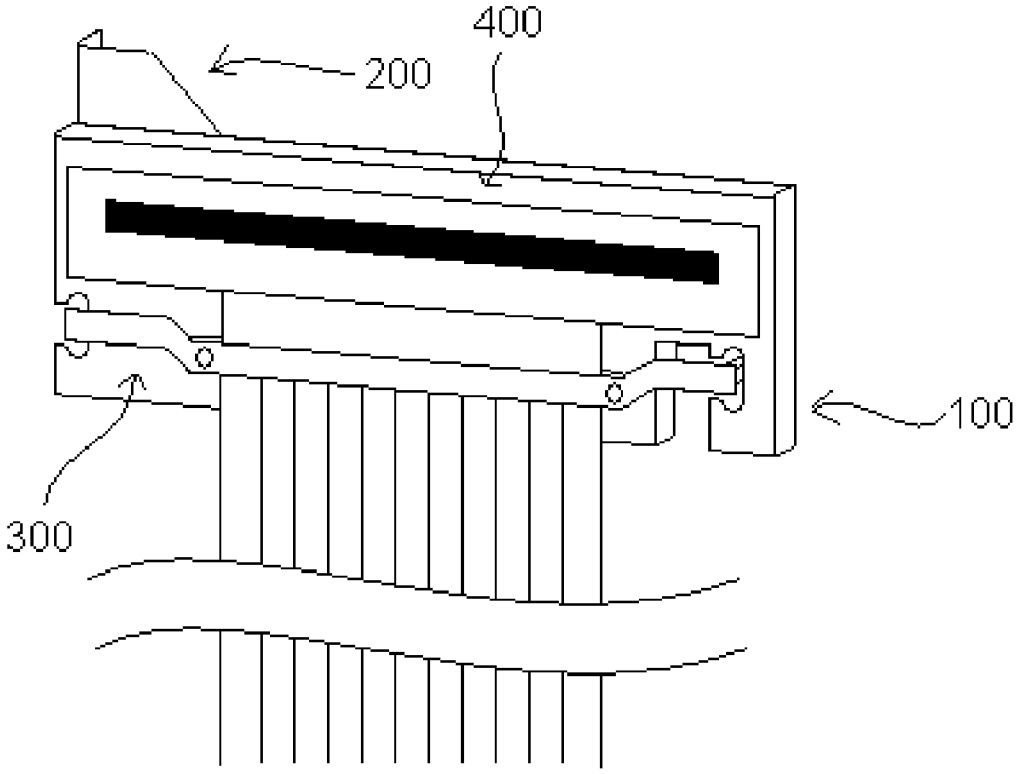
FIG. 1 is a front perspective view illustrating a toolless thermal print head mounting apparatus in accordance with the present invention.

FIG. 1 is a front perspective view illustrating a toolless thermal print head mounting apparatus 100 in accordance with the present invention. As shown in FIG. 1, a toolless thermal print head mounting apparatus includes a print head mounting bracket 100, a capture latch 200, a floating cable clamp 300 and a thermal print head 400. As will be described in more detail below, the thermal print head 400 is coupled to the floating cable clamp 300 and the capture latch 200, and all of the above are coupled to the print head mounting bracket 100.

Figure 2A:
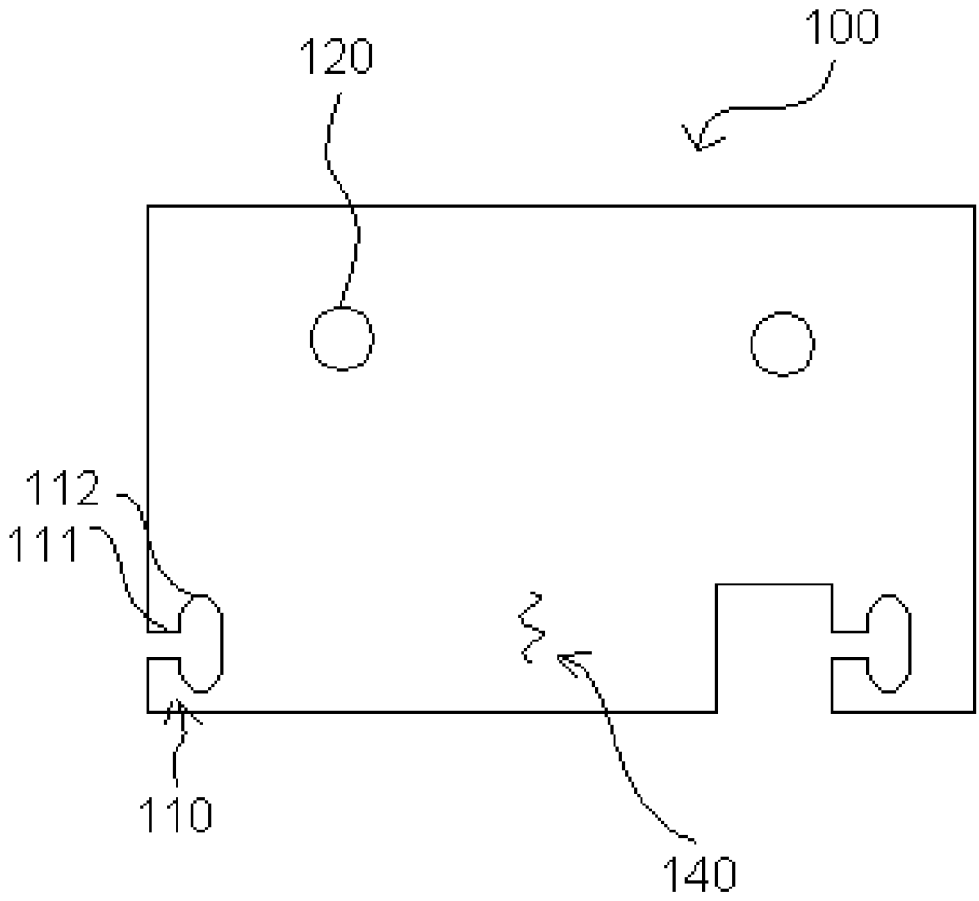
FIG. 2A is a front plan view of a print head mounting bracket of a thermal print head mounting apparatus in accordance with the present invention.
Figure 2B:
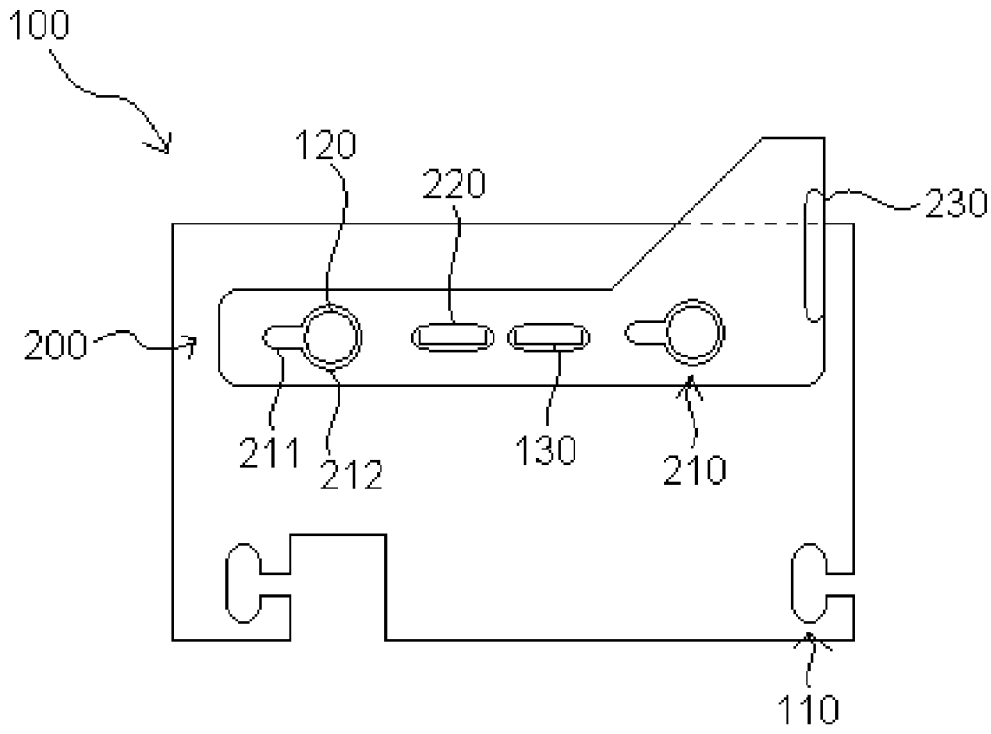
FIG. 2B is a rear plan view of a print head mounting bracket including a capture latch of a thermal print head mounting apparatus in accordance with the present invention.

FIG. 2A and 2B are a front perspective view and a rear perspective view, respectively, of the print head mounting bracket 100. FIG. 2B also shows the disposition of the capture latch 200 on the print head mounting bracket 100. The print head mounting bracket 100 includes slots 110 for the floating cable clamp 300. The slots 110 each include a horizontal slot 111 and a vertical slot 1 12. The horizontal slot 111 is open to an exterior of the print head mounting bracket 100. The slots 110 accept shoulder pins disposed on the rear of the floating cable clamp 300 as will be described in more detail below. Alternative exemplary embodiments include configurations wherein the print head mounting bracket 100 includes three or more slots 1 10.

The print head mounting bracket 100 also includes print head mounting holes 120. As shown in FIG. 2B, the print head mounting holes 120 are aligned with dual key-slots 210 in the capture latch 200. The print head mounting holes 120 and the key-slots 210 accept mounting studs disposed on the print head 400 as will be described in more detail below. Each key-slot 210 in the capture latch 200 includes a first opening 211 having a first width and a second opening 212 having a larger width. Alternative exemplary embodiments include configurations wherein the print head mounting bracket 100 includes three or more print head mounting holes 110; in such exemplary embodiments the capture latch 200 may include a corresponding number of key-slots 210.

Also shown in FIG. 2B is a pair of capture latch mounting studs 130. The capture latch mounting studs 130 extend away from the rear of the print head mounting bracket 100 and pass through capture latch mounting slots 220 in the capture latch 200. Once the capture latch mounting studs 130 are passed through the capture latch mounting slots 220, they may be bent or twisted to allow the capture latch 200 to move in a side-to-side manner along the rear of the print head mounting bracket 100. The twisted capture latch mounting studs 130 prevent movement of the capture latch 200 in a direction away from the print head mounting bracket 100. Alternative exemplary embodiments may include configurations wherein the capture latch 200 is coupled to the print head mounting bracket 100 in various other ways as would be apparent to one of ordinary skill in the art.

In the present exemplary embodiment the capture latch 200 includes a handle 230 to allow a user to more easily move the capture latch 200 in a side-to-side manner as will be described in more detail below. Alternative exemplary embodiments include configurations wherein the handle 230 is omitted.

In the present exemplary embodiment the print head mounting bracket 100 may also include a spring element 140 disposed on a front face thereof to apply an outward force to the floating cable clamp 300 as will be described in more detail below.

Figure 3A:
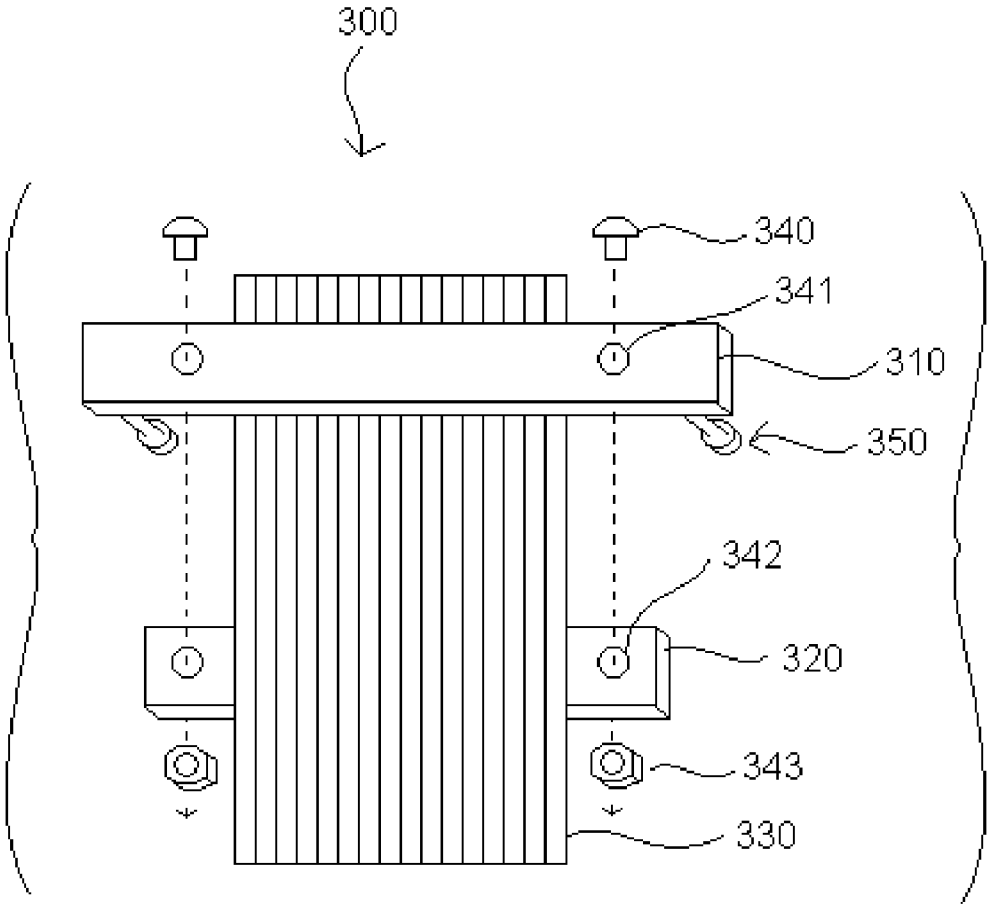
FIG. 3A is an exploded view of a floating cable clamp of a thermal print head mounting apparatus in accordance with the present invention.
Figure 3B:
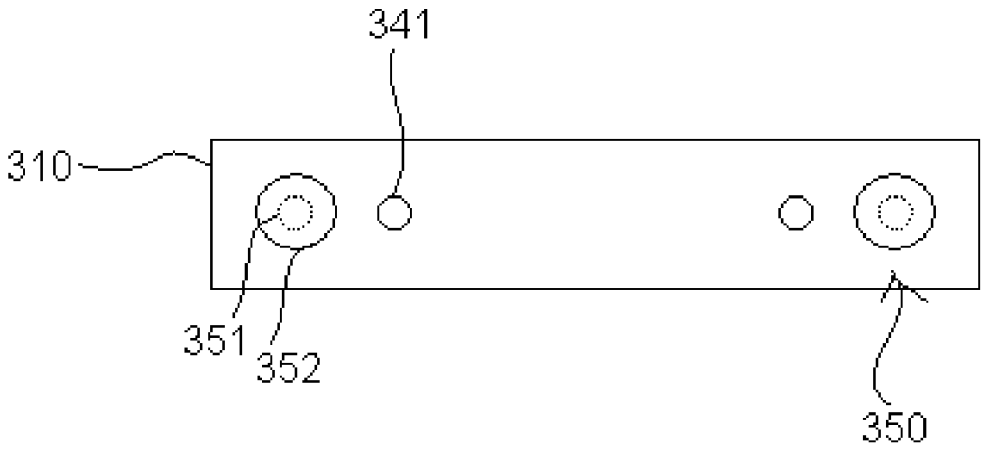
FIG. 3B is a rear plan view of the floating cable clamp of a thermal print head mounting apparatus in accordance with the present invention.

Referring now to FIGS. 3A and 3B, a floating cable clamp 300 includes a front clamp 310 and a rear clamp 320 with a cable 330 disposed therebetween. The front clamp 310 and the rear clamp are connected to fix the cable 330 in position for mounting to the thermal print head 400. In the present exemplary embodiment the front clamp 310 and the rear clamp 320 are coupled via clamp screws 340 which are passed through fixing holes 341 and 342 in the front and rear clamps 310 and 320, respectively, and fixed in position with clamp screw bolts 343. Alternative exemplary embodiments include configurations wherein the front clamp 310 and rear clamp 320 are connected via other means as would be apparent to one or ordinary skill in the art. Alternative exemplary embodiments also include configurations wherein the floating cable clamp 300 is formed from a unitary indivisible element and the cable 330 is fixed in position with respect thereto via other means as would be apparent to one or ordinary skill in the art.

As shown in FIG. 3B, shoulder pins 350 are disposed on a rear surface of the front clamp 310 of the floating cable clamp 300. The shoulder pins 350 are aligned with the slots 110 in the print head mounting bracket 100 as will be discussed in more detail below. The shoulder pins 350 include a long neck 351 with a head 352 disposed thereon. Exemplary embodiments include configurations wherein the shoulder pins 350 may alternatively be disposed on the rear clamp 320, or on both the front clamp 310 and the rear clamp 320. The shoulder pins 350 may be unitarily and indivisibly formed with the cable clamp 300 or may be separately formed and then later attached thereto, e.g., the shoulder pins 350 may be formed as screws and then mechanically coupled to the clamp 300, as would be apparent to one of ordinary skill in the art.

Figure 4A:
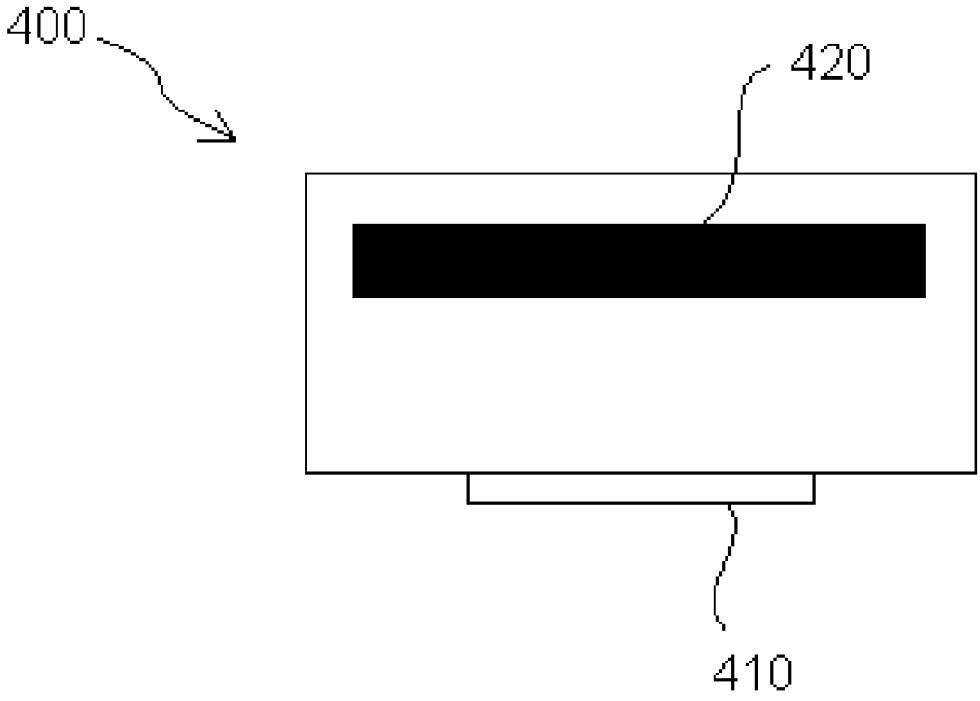
FIG. 4A is a front plan view of a thermal print head of a thermal print head mounting apparatus in accordance with the present invention.
Figure 4B:
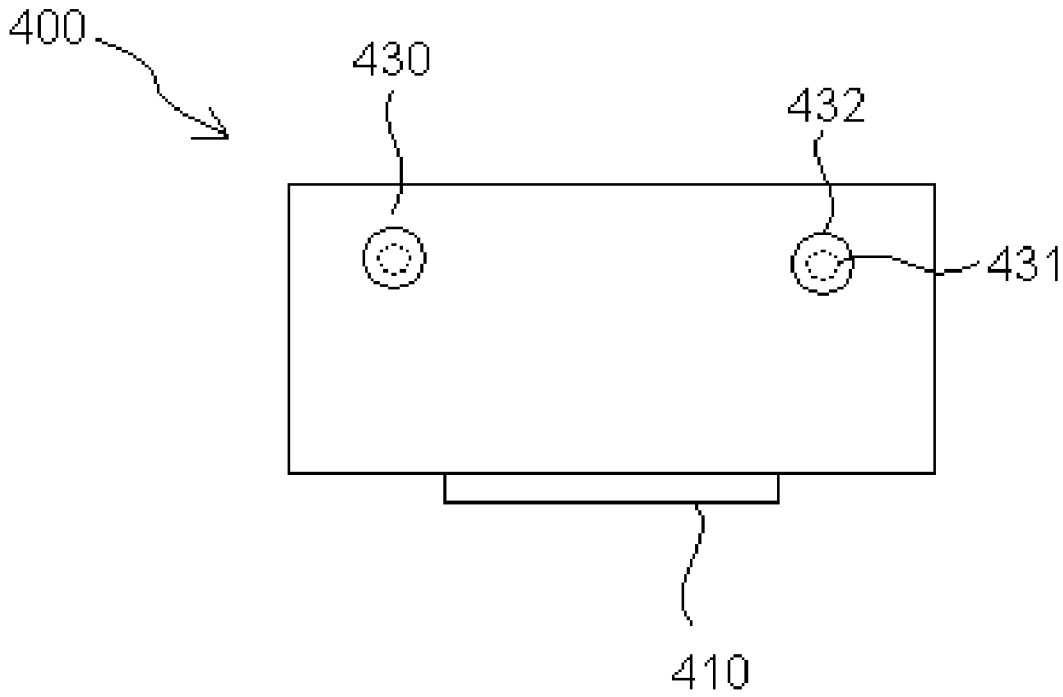
FIG. 4B is a rear plan view of a thermal print head of a thermal print head mounting apparatus in accordance with the present invention.

FIGS. 4A and 4B are front and rear perspective views of a thermal print head 400, respectively, in accordance with the present invention. As shown in FIG. 4A, the thermal print head 400 includes a print head connector 410 which connects the thermal print head 400 to the cable 330. The thermal print head 400 also includes a print line 420 wherein heating elements (not shown) are disposed for printing to a surface.

As shown in FIG. 4B, the thermal print head 400 also includes print head mounting studs 430 disposed on a rear surface thereof The print head mounting studs 430 project from the rear surface of the thermal print head and are aligned with the print head mounting holes 120 and key-slots 210 of the print head mounting bracket 100 and the capture latch 200, respectively. In one exemplary embodiment the width of the print head mounting studs 430 varies with distance from the rear of the thermal print head 400. In such an exemplary embodiment, the width of a first portion 431 of the print head mounting studs 430 may be substantially equal to the width of the first opening 211 in the key-slot 210 and the width of a second portion 432 of the print head mounting studs 430 has a larger width than the first portion 431. In such an exemplary embodiment, the first portion 431 is disposed in proximity to the thermal print head 400 and the second portion 432 is disposed further from the thermal print head 400 than the first portion 431.

Now an exemplary embodiment of a method of operating the exemplary embodiment of a toolless thermal print head mounting apparatus will be described in more detail with reference to FIGS. 1-4B.

As shown in FIG. 1, the floating cable clamp 300 is coupled to the print head mounting bracket 100. The shoulder pins 350 of the floating cable clamp 300 are inserted through the horizontal slots 111 of the print head mounting bracket 100 into the vertical slots 112. The neck 351 passes through the slots 110 and the head 352 is captured behind the print head mounting bracket 100. The length of the shoulder pins 350 is long enough so that the entire floating cable clamp 300, including the front clamp 301, the rear clamp 320 and the cable 330, may be pivoted outwards from the print head mounting bracket 100. The spring element 140 provides the floating cable clamp 300 with a pivoting force away from the print head mounting bracket 100 in the exemplary embodiment wherein it is included. The thermal print head 400 may be easily attached to, or removed from, the cable 300 via the print head connector 410 when the floating cable clamp 300 is in the pivoted position.

With the thermal print head 400 attached to the cable 330, the floating cable clamp 300 is then pivoted and positioned vertically so that the thermal print head 400 and the print head mounting bracket 100 are substantially parallel. One advantage of the floating cable clamp 300 being attached to the print head mounting bracket 100 via the shoulder pins 350 is that the entire floating cable clamp 300 may be moved vertically up or down with respect to the print head mounting bracket 100 in the vertical slots 112 in order to accommodate larger or smaller thermal print heads 400 as necessary.

At this point the print head mounting studs 430 are aligned with the print head mounting holes 120 and the key slots 210. The capture latch 200 is positioned with respect to the print head mounting bracket 100 so that the second opening 212 of the key slot 210 is aligned with the print head mounting hole 120. The print head mounting studs 430 are then inserted through the mounting stud holes 120 and the key slots 210.

The capture latch 200 is then slid horizontally in place so that the first opening 211 of the key slot 210 is moved between the first portion 431 and second portion 432 of the print head mounting studs 430. This ensures that the thermal print head 400 is restrained with respect to the print head mounting bracket 100.

Alternative exemplary embodiments include configurations wherein the capture latch 200 includes various other means of restraining the thermal print head 400 with respect to the print head mounting bracket 100 as would be apparent to one of ordinary skill in the art.

Figure 5:
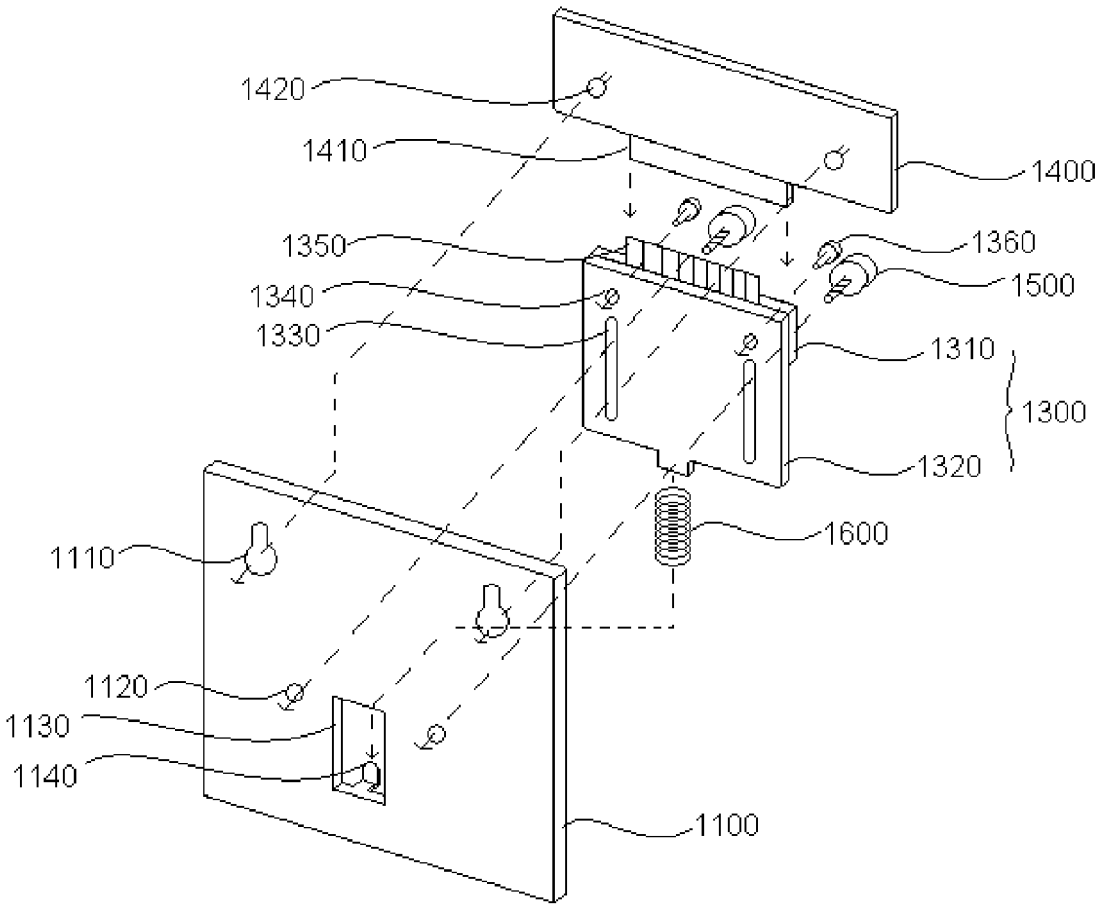
FIG. 5 is an exploded rear view of another exemplary embodiment of a thermal print head mounting apparatus in accordance with the present invention.

Referring now to FIG. 5, an exploded rear view of another exemplary embodiment of a thermal print head mounting apparatus in accordance with the present invention includes a print head mounting bracket 1100 and a floating cable clamp 1300 for mounting a thermal print head 1400 thereon.

As shown in FIG. 5, the print head mounting bracket 1100 of the present exemplary embodiment includes dual key-hole slots 1110, dual shoulder screw slots 1120, an opening 1130 and a tab 1140 disposed to project outward and upward from a front face of the print head mounting bracket 1100. Alternative exemplary embodiments include configurations wherein the number of key-hole slots 1110, cable clamp shoulder screw slots 1120, openings 1130 and tabs 1140 are increased or decreased as would be apparent to one of ordinary skill in the art. Alternative exemplary embodiments also include configurations wherein the opening 1130 is omitted.

The floating cable clamp 1300 includes a front clamp 1310 and a rear clamp 1320. In the present exemplary embodiment the rear clamp 1310 includes dual shoulder screw slots 1330, and both the front and the rear clamps 1310 and 1320 include cable clamp screw slots 1340. Alternative exemplary embodiments include configurations wherein shoulder screw slots 1330 may be formed in both the front and rear clamps 1310 and 1320. The front and rear clamps 1310 and 1320 are configured to restrain a cable 1350 disposed therebetween. The front and rear clamps 1310 and 1320 are coupled by cable clamp screws 1360 passing through the cable clamp screw slots 1340. Alternative exemplary embodiments include configurations wherein the front and rear clamps 1310 and 1320 are coupled through other means as would be apparent to one of ordinary skill in the art, e.g., a restraining clip, an adhesive, bur and hook fasteners, etc.

The thermal print head 1400 includes a thermal print head connector 1410 and dual mounting studs 1420. Alternative exemplary embodiments include configurations wherein the number of mounting studs 1420 are increased or decreased as would be apparent to one of ordinary skill in the art. In one exemplary embodiment the mounting studs 1420 may be screws that are permanently screwed into the thermal print head 1400.

In operation the thermal print head 1400 is coupled to the cable 1350, which is restrained by the floating cable clamp 1300, via the thermal print head connector 1410. The floating cable clamp 1300 is floatingly connected to the print head mounting bracket 1100 by a pair of shoulder screws 1500 inserted through the shoulder screw slots 1330 and the cable clamp shoulder screw slots 1120. The floating cable clamp 1300 is spring loaded upward on the print head mounting bracket 1100 by a cable clamp spring 1600. The thermal print head 1400 is coupled to the print head mounting bracket by insertion of the print head mounting studs 1420 into the dual key-hole slots 1110 on the print head mounting bracket 1100. Alternative exemplary embodiments include configurations wherein the number of shoulder screws 1500 is increased or decreased as would be apparent to one of ordinary skill in the art.

This abovedescribed configuration allows the floating cable clamp 1300 to slide up and down and to pivot outward slightly away from the print head mounting bracket 1100. In one exemplary embodiment the cable clamp spring 1600 provides sufficient upward force to the floating cable clamp 1300 to exceed the force required for insertion of the cable 1350 into the thermal print head connector 1410. In addition, in one exemplary embodiment a top surface of the cable clamp 1300 engages a bottom surface of the thermal print head connector 1410 when fully seated; such a configuration may prevent excessive upward forces from damaging the cable 1350.

Removal of a failed thermal print head 1400 is achieved by pressing the thermal print head 1400 downward until the thermal print head mounting studs 1420 are in the round portion of the dual key-hole slots 1110. The thermal print head 1400 is then rotated until the thermal print head mounting studs 1420 clear the print head mounting bracket 1100. The thermal print head 1400 is then pulled upward to disconnect the thermal print head connector 1410 from the cable 1350. Installing a new thermal print head 1400 follows the above procedure in reverse.

In addition to the ease of removal of a failed thermal print head 1400, the abovedescribed exemplary embodiment also is capable of accommodating thermal print heads 1400 of various dimensions because of the ability of the floating cable clamp 1300 to float upward or downward with respect to the thermal print head mounting bracket 1100.

The abovedescribed exemplary embodiments of a toolless thermal print head mounting apparatus allow for easy toolless removal of the thermal print head from the cable and the print head mounting bracket. Furthermore, the abovedescribed exemplary embodiments do so simply and inexpensively and provide the ability for a plurality of differently sized thermal print heads to be accommodated.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. A toolless thermal print head mounting apparatus comprising:

a print head mounting bracket, having front and rear opposing faces, and including key-hole slots, first shoulder screw slots, an opening and a tab disposed to project outward and upward from the front face;

a floating cable clamp, including front and rear clamps, in which screw slots and second shoulder screw slots are defined, the front and rear clamps being configured to restrain a cable and coupled to one another by cable clamp screws passing through the screw slots, the floating cable clamp being upwardly spring loaded on the print head mounting bracket via a spring disposed proximate the opening and on the tab, and being floatingly connected to the print head mounting bracket by a pair of shoulder screws inserted through the first and second screw slots; and a thermal print head, including a thermal print head connector and dual mounting studs, which is coupled to the cable via the thermal print head connector, and which is coupled to the print head mounting bracket by way of an insertion of the print head mounting studs through the key-hole slots, wherein:

the floating cable clamp is configured to slide up and down and to pivot away from the print head mounting bracket, the spring provides an upward force to the floating cable clamp in excess of a force required for insertion of the cable into the thermal print head connector, and a top surface of the floating cable clamp engages a bottom surface of the thermal print head connector when the floating cable clamp is fully seated.

* * * * *